United States Patent [19]

Gunneman

[11] 4,031,928

[45] June 28, 1977

[54] STORING MEANS FOR FORMING LOOP-SHAPED YARN LENGTHS IN A TEXTILE MACHINE

[75] Inventor: Paul Gunneman, Helmond, Netherlands

[73] Assignee: Ruti-Te Strake B.V., Deurne, Netherlands

[22] Filed: Dec. 24, 1975

[21] Appl. No.: 644,185

[30] Foreign Application Priority Data

Apr. 9, 1975 Netherlands ..... 7504245

[52] U.S. Cl. ..... 139/452; 226/97; 226/119

[51] Int. Cl.² ..... D03D 47/36; B65H 17/32

[58] Field of Search ..... 139/122 H, 127 P, 450, 139/452, 435; 226/113, 117, 118, 97

[56] References Cited

UNITED STATES PATENTS

| | | | |
|---|---|---|---|
| 3,580,444 | 5/1971 | Mullekom | 139/452 |
| 3,675,687 | 7/1972 | Vermeulen et al. | 139/452 |
| 3,918,501 | 11/1975 | Wolstencroft | 139/452 |

*Primary Examiner*—Henry S. Jaudon
*Attorney, Agent, or Firm*—Marshall & Yeasting

[57] ABSTRACT

A substantially flat horizontal conduit has one end connected to a suction device and the other end open and located adjacent to a blowing nozzle adapted to feed the yarn to be stored. A trough-like yarn-storing means is provided immediately above and substantially coextensive with said conduit, and said blowing nozzle is spaced from and directed toward the end of said trough-like means, the axis of said nozzle extending just above the level of said conduit and at the level of said trough-like means.

4 Claims, 3 Drawing Figures

STORING MEANS FOR FORMING LOOP-SHAPED YARN LENGTHS IN A TEXTILE MACHINE

BACKGROUND OF THE INVENTION

The invention relates to a storing means for forming loop-shaped yarn lengths in a textile machine, particularly a shuttleless weaving machine, comprising a substantially flat conduit which at one end is connected to a suction device and at the other end co-operates with a blowing nozzle adapted to feed the yarn to be stored.

Storing means of this type are known and are e.g. used in the weft preparation in a weaving machine of the type in which the weft insertion is effected by means of a jet of fluid e.g. air. The weft yarn is usually continuously drawn from a stationary yarn package and is blown by the blowing nozzle into the flattened storing conduit as a substantially U-shaped loop, which is thereafter withdrawn from the conduit during the weft insertion phase and inserted in the weaving shed by means of a weft transporting device e.g. an air blowing nozzle.

Exerting suction at the end of the flattened conduit remote from the blowing nozzle is necessary in order to prevent the legs of the loop from becoming entangled. This applies in particular to so-called highly twined "lively" yarns. It is mostly the friction between the yarn and the conduit walls which must be overcome by the suction.

It has already been proposed to use a trough-like storing means into which the yarn - which is continuously fed from a supply - is blown as a U-shaped loop by means of the blowing nozzle co-operating with it. In such an "open" storing means the friction between the yarn and the walls of the storing means is decreased as compared with the friction in a "closed" storing means of the flattened conduit type to the extent that during operation the kinetic energy applied to the upstream loop leg by the blowing nozzle is sufficient to prevent the loop legs from entangling. However, there is still a chance of entangling of the loop legs during starting up of the weaving machine when the yarn still has to gain speed.

SUMMARY OF THE INVENTION

According to the invention the advantages of a closed storing means with suction and of an open storing means without suction are combined in a practical manner and thereby the disadvantages of both types of storing means are obviated in that the axis of the blowing nozzle which has its blowing aperture spaced in front of the inlet opening of the storing conduit extends just over the upper wall of the conduit, a second storing means which is open at its upper side, being arranged immediately above the conduit.

Such a combined storing means offers the possibility to make use of the lower flattened conduit as a storing means during the starting of the weaving machine. The suction generated in this storing means prevents the loop legs from entangling, while the upstream leg is still in the process of gaining speed. At the end of the first weft insertion, when the loop length collected in the flattened conduit has completely been consumed, the incoming weft yarn, supplied by the blowing nozzle, has gained the correct speed, and the kinetic energy of this yarn makes it possible to continue the formation of loops in the upper open storing means. The suction in the lower closed storing means may then be cut off if desired, e.g. automatically through the intermediary of a timed switch or similar means, or may be continued for sucking off fluffs that possibly collect at the entrance of the storing means.

In a preferred embodiment the blowing nozzle is mounted in an auxiliary element comprising a box-shaped part having a bottom aligned with the lower wall of the flattened conduit, two side walls which are aligned with the sides of the storing means and an end wall remote from the inlet opening of the storing means, the blowing end of the blowing nozzle as well as a guiding eye for the downstream leg of the yarn loop being provided in said end wall.

DESCRIPTION OF THE PREFERRED EMBODIMENT

Figure 1:
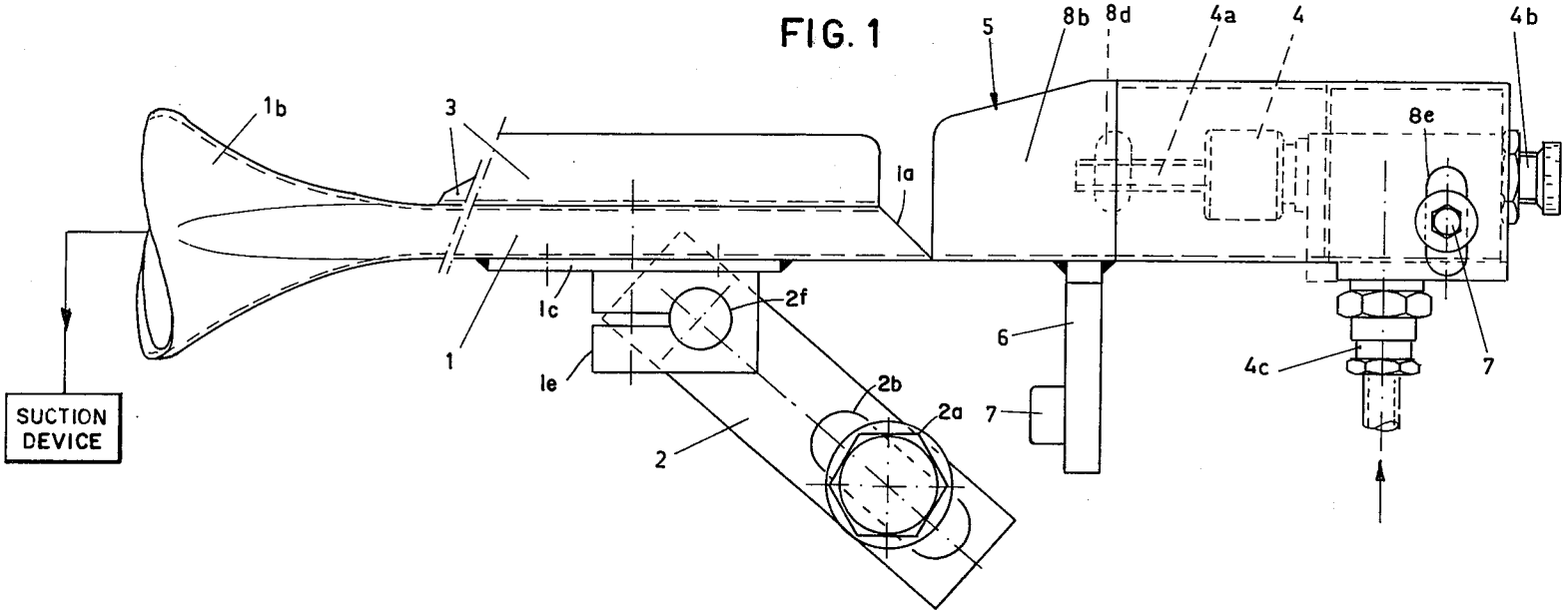
FIG. 1 is a side view of the storing means according to the invention.
Figure 3:
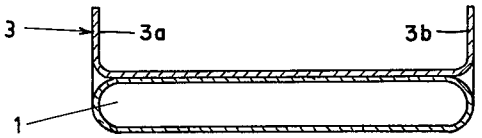
FIG. 3 is a cross-section through the storing means proper.

The storing means 1 is formed as a flattened conduit (vide particularly FIG. 3) and is mounted by means of a plurality of brackets 2, one of which is shown in the drawing, in a substantially horizontal position onto the frame of a weaving machine not further shown. Each bracket 2 is secured to the frame of the machine by means of a screw 2*a* which extends through a slot 2*b* in the bracket 2. A plate 1*c* welded to the conduit 1 is provided with a slot 1*d*. A pin 2*c* is fixed in the upper end of each bracket 2, and is secured in a clamp 1*e* which in turn is fastened to the plate 1*c* by means of a screw 1*f* extending through the slot 1*d*. It will be evident from the drawings that when the screw 2*a* is loosened, the bracket 2 can be moved lengthwise relative to the screw 2*a* or can be tilted, and the conduit 1 can be tilted relatively to the bracket 2 by loosening the screw 1*f*. At the same time, loosening of the screw 1*f* permits the conduit 1 and the plate 1*c* to be adjusted longitudinally relative to the clamp 1*e*. In this way, the position of the conduit 1 is fully adjustable relative to the frame of the machine. The right-hand end 1*a*, of the conduit 1 as seen in the drawing, faces upward at an angle to the verticle and constitutes the inlet of the storing means 1, whereas the left-hand end merges into a cylindrical connecting socket 1*b* for a suction device. On top of the storing means 1 a second through-like storing means 3 has been provided which is open at the upper side and has its bottom wall resting upon the upper wall of the storing conduit 1. The side walls 3*a* and 3*b* of the trough-like storing means 3 taper down at their ends, as shown at the left in FIG. 1.

A blowing nozzle 4 is mounted in an auxiliary element 5. Said auxiliary element is mounted on the frame of the machine by means of a bracket 6 secured by means of a bolt 7 extending through a slot 6*a* in the bracket 6, and has a box-shaped part 8. The bottom 8*a* of this box-shaped part is in alignment with the bottom wall of the flat storing conduit 1, both side walls 8*b* being in alignment with the side walls 3*a* and 3*b* of the storing means 3. The box-shaped part 8 has a back wall 8*c* which is inclined with respect to the longitudinal axis of the storing means 1. The blowing end 4*a* of the blowing nozzle 4 extends through an opening in said back wall 8*c* into the box-shaped part 8. Said opening is lined with a sleeve 8*d* surrounding the blowing end 4*a*. An eye 8*e* at the juncture of a side wall 8*b* and said back wall 8*c* guides the downstream loop leg from the box-shaped part 8 outwardly. The blowing nozzle 4 is of the conventional type employed for propelling the yarn which extends axially through the blowing nozzle assembly. The blowing nozzle 4 is secured in a vertically adjustable position by means of a screw 7 passing through a slot 8*e* in the side wall 8*b*. The entire assembly 5 carried on the bracket 6 can be adjusted by loosening the screw 7 which secures the bracket 6 to the frame of the machine and which extends through the slot 6*a* in the bracket 6.

The blowing nozzle 4 has its blowing end spaced from the inlet 1*a* of the storing means 1. The axis of the blowing nozzle extends parallel to the one side wall 8*a* of the storing means 3 and extends also just over the lower storing means 1. Thus the blowing end 4*a* of the blowing nozzle 4 is directed towards the upper open storing means 3.

Figure 2:
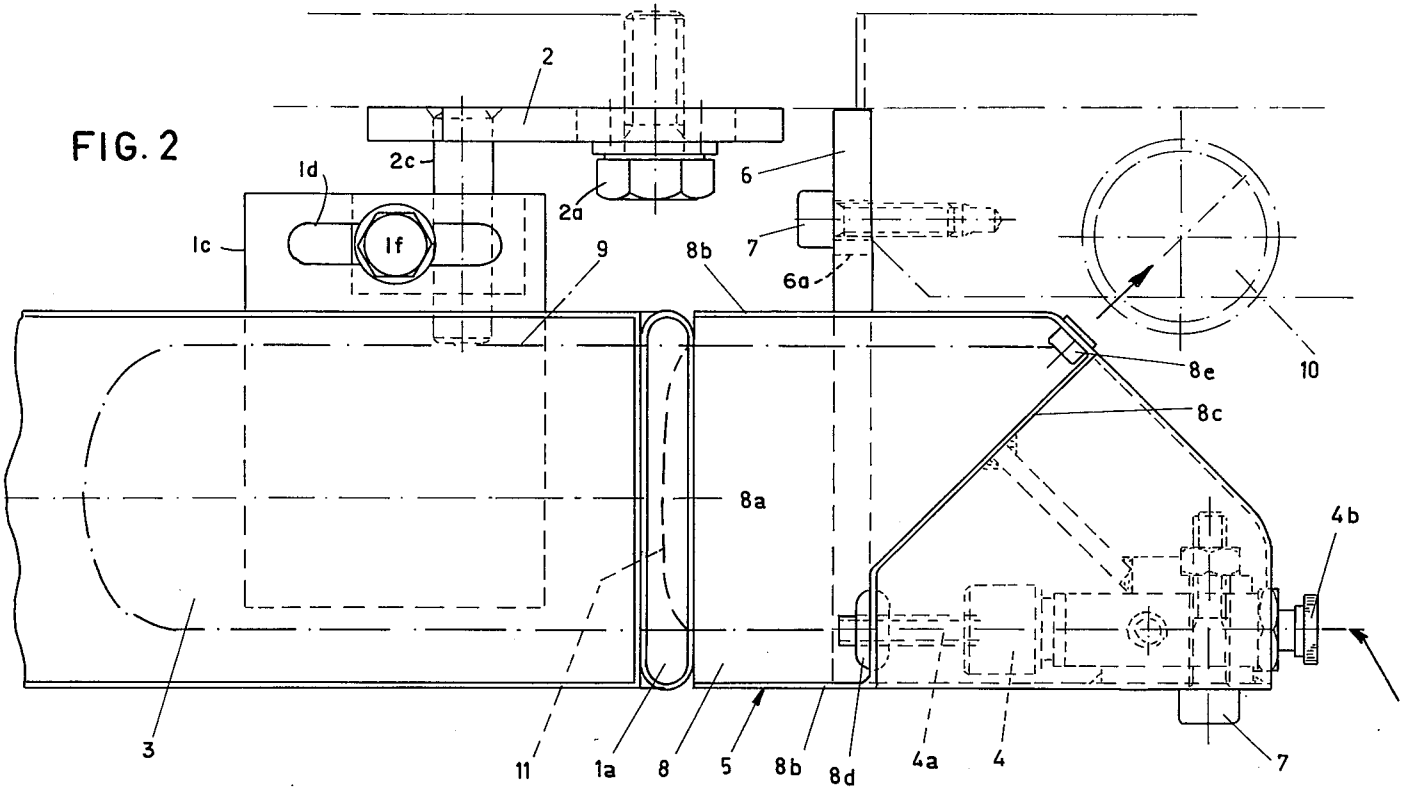
FIG. 2 is a plan view thereof.

The yarn continuously drawn by drawing rollers (not shown in the drawing) from a stationary package is supplied at 4*b* to the blowing nozzle 4, said nozzle being fed with blowing air supplied at 4*c* and during normal operation blowing the yarn in the direction of its axis into the upper storing means 3. In accordance with conventional operating procedure, the blowing nozzle is continuously supplied with air, and propels the yarn continuously at a constant speed. The yarn is received in the storing means 3 in the shape of a loop as indicated by dot and dash lines in FIG. 2. The outgoing leg 9 of this loop leaves the storing means and the box-shaped part 8 of the auxiliary element 5 through the guiding eye 8*e* from which the yarn is guided by means of the thread clamp, schematically indicated at 10, to the weft transporting means, e.g. a blowing nozzle. In accordance with conventional operating procedure, each time the yarn is injected to form a weft thread, substantially the entire loop is drawn out of the storing means. A new loop of the yarn then forms prior to the next weft injection.

At the beginning of the weaving process, when the weaving machine is put into operation, the weaver takes care that the first loop is formed in the lower storing means 1. For this purpose he manually places the yarn portion 11, indicated in FIG. 2 by broken lines, in front of the entrance 1*a* of the lower storing means 1 so that it is subjected to the influence of the suction generated in the storing means 1. In this way, the first loop is formed in the conduit 1 while the machine is being started, before the yarn extending through the nozzle 4 has attained its normal operating speed. The suction applied to the remote end of the conduit 1 prevents the first loop of yarn from becoming tangled or twisted. By the time when the second loop of yarn is to be formed, the yarn passing through the blowing nozzle 4 has substantially attained its normal operating speed, and the blowing nozzle 4 will propel the second loop of yarn into the upper storing means 3. Thus the lower conduit is used only for the formation of the first loop of yarn when the machine is first started, and the conduit 1 remains empty during normal operation of the machine. As hereinbefore stated, suction may be applied to the conduit 1 only during the formation of the first loop of yarn, or suction may remain continuously on the conduit 1 during the operation of the machine in order to remove any fuzz which may accumulate adjacent to the inlet opening 1*a*. After the machine has reached its normal operational speed and the storing means 1 has been emptied during the first weft injection, the loop forming operation is automatically continued in the upper open storing means 3.

Dependent on the type of the yarn to be handled the position of the auxiliary element 5 and/or of the blowing nozzle 4 with respect to the storing means 1 and 3 may be adjusted through a certain range. The securing bolts 7 thereto co-operate with elongated slots.

I claim:

1. A storing means for forming loop-shaped yarn lengths in a textile machine, comprising a substantially flat horizontal conduit having one end connected to a suction device and the other end open and located adjacent to a blowing nozzle adapted to feed the yarn to be stored, characterized in that a trough-like yarn-storing means is provided immediately above and substantially coextensive with said conduit, and said blowing nozzle is spaced from and directed toward the end of said trough-like means, the axis of said nozzle extending just above the level of said conduit and at the level of said trough-like means.

2. A storing means according to claim 1, comprising a box-like means having a bottom in alignment with the bottom of the horizontal conduit, two side walls in alignment with the sides of said conduit, and an end wall remote from the end of said conduit, the blowing nozzle being mounted on said box-like means and projecting through said end wall, and a guiding eye for the downstream leg of the yarn loop being located at the juncture of the end wall and a side wall of said box-like means.

3. A storing means according to claim 2, wherein the box-like means is adjustable relative to the trough-like yarn-storing means.

4. A storing means according to claim 1, wherein the blowing nozzle is vertically adjustable relative to the trough-like yarn-storing means.

* * * * *